United States Patent [19]

Corwin

[11] Patent Number: 4,735,771

[45] Date of Patent: Apr. 5, 1988

[54] METHOD OF PREPARING OXIDATION RESISTANT IRON BASE ALLOY COMPOSITIONS

[75] Inventor: John M. Corwin, Royal Oak, Mich.

[73] Assignee: Chrysler Motors Corporation, Highland Park, Mich.

[21] Appl. No.: 938,180

[22] Filed: Dec. 3, 1986

[51] Int. Cl.[4] ..... C21C 33/00; C22C 19/03

[52] U.S. Cl. ..... 420/129; 420/40; 420/441; 420/443

[58] Field of Search ..... 420/129, 83, 84, 18, 420/443, 25, 8, 40

[56] References Cited

U.S. PATENT DOCUMENTS

| | | | |
|---|---|---|---|
| Re. 24,242 | 12/1956 | Lohr | 75/171 |
| Re. 24,243 | 12/1956 | Lohr | 75/171 |
| Re. 31,339 | 8/1983 | Dardi et al. | 148/4 |
| 648,428 | 5/1900 | Patrick | 420/441 |
| 1,653,630 | 5/1927 | Kiam | 420/558 |
| 1,920,934 | 8/1933 | Keen | 75/1 |
| 1,962,599 | 6/1934 | Keen | 75/1 |
| 3,591,371 | 7/1971 | Hatwell et al. | 420/588 |
| 3,676,085 | 7/1972 | Evans et al. | 420/588 |
| 3,852,063 | 12/1974 | Niimi | 420/40 |
| 3,859,060 | 1/1975 | Eiselstein et al. | 420/443 |
| 3,865,581 | 2/1975 | Sekino et al. | 420/40 |
| 4,022,587 | 5/1977 | Wlodek | 420/443 |
| 4,053,308 | 10/1977 | Tesk et al. | 420/443 |
| 4,133,680 | 1/1979 | Babaskin | 420/443 |
| 4,157,923 | 6/1979 | Yen et al. | 148/4 |
| 4,159,908 | 7/1979 | Rao et al. | 420/565 |
| 4,322,248 | 3/1982 | Patrician et al. | 420/429 |
| 4,388,125 | 6/1983 | Benn | 420/443 |
| 4,400,209 | 8/1983 | Kudo et al. | 420/452 |
| 4,400,211 | 8/1983 | Kudo et al. | 420/452 |
| 4,572,750 | 2/1986 | Masumoto et al. | 420/443 |
| 4,600,556 | 7/1986 | Donachie et al. | 420/543 |
| 4,612,166 | 9/1986 | Brock et al. | 420/490 |
| 4,636,357 | 1/1987 | Peel et al. | 420/532 |
| 4,652,299 | 3/1987 | Bienvenu et al. | 420/590 |

FOREIGN PATENT DOCUMENTS

| | | | |
|---|---|---|---|
| 2036793 | 7/1980 | United Kingdom | 420/443 |

OTHER PUBLICATIONS

Article entitled: "The Design of Optimum Multifactorial Experiments"; by R. L. Plackett and J. P. Burman from *Biometrika*, 1946, pp. 305–327.

Article entitled: "Some Generalizations in the Multifactorial Design"; by R. L. Plackett from *Biometrika*, 1946, pp. 328–332.

Article entitled: "Table of Percentage Points of the T-Distribution" by E. M. Baldwin from *Biometrika*, 1946, p. 362.

Article entitled: "Industrial Statistics" by W. Volk from *Chemical Engineering*, Mar. 1956.

*Metals Handbook*, Eighth Edition, vol. 2, Lyman, pp. 507–516.

Society of Automotive Engineers (SAE) Paper No. 740093 by A. Roy, F. A. Hagen and J. M. Corwin entitled "Performance of Heat-Resistant Alloys in Emission-Control Systems" (1974).

*Primary Examiner*—Peter D. Rosenberg

*Attorney, Agent, or Firm*—Mark P. Calcaterra

[57] ABSTRACT

The method disclosed herein involves the addition of small quantities of elements appearing for the most part in Groups IA, IIA and IIIB of the Periodic Table to the base alloy composition. These elements, as ions, enter into the protective oxide scale and modify predominantly anion and to a lesser extent cation transport through the oxide scale, greatly reducing the amount of oxidation observed due to elevated temperature exposure.

39 Claims, 2 Drawing Sheets

FIG. 2.
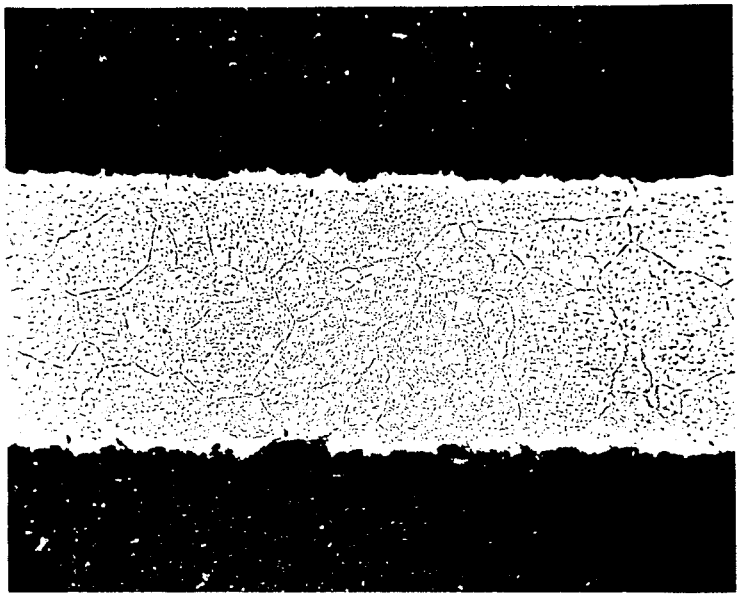
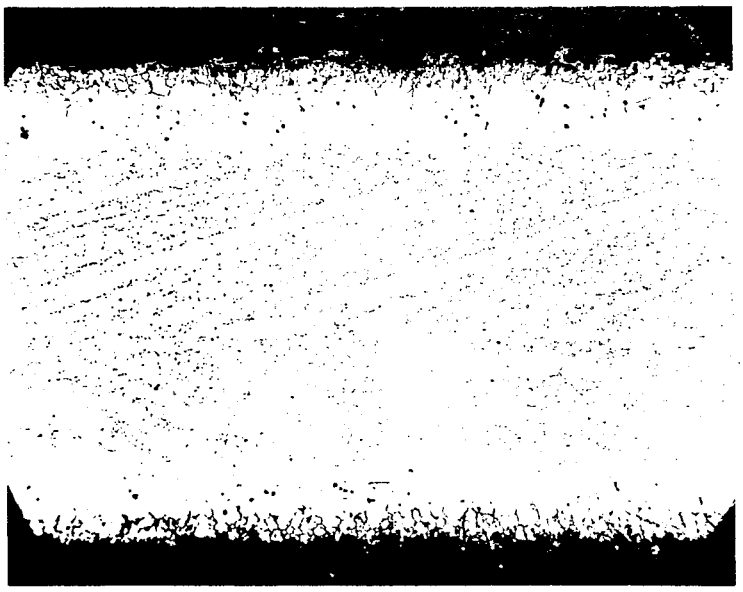
FIG. 3.

METHOD OF PREPARING OXIDATION RESISTANT IRON BASE ALLOY COMPOSITIONS

BACKGROUND AND SUMMARY OF THE INVENTION

This invention relates to ferrous alloy compositions and to methods of preparing such compositions. In a further aspect, this invention relates to dopants added to austenitic and ferritic ferrous alloys as a means of improving the elevated temperature oxidation resistance.

Compared to traditional cast iron construction, sheet metal automotive exhaust system parts such as thermal reactors and turbocharger housings would offer advantages of lighter weight and reduced thermal mass. To maximize the advantages, the metal thickness of wrought automotive engine parts should be minimized. This can be accomplished by constructing the engine parts from stainless steels, austenitic where hot strength is required, with alloying suitable for resistance to deterioration by engine exhaust gases on the inside surface of the engine parts and atmospheric air on the outside surface of the engine parts where the surface operating temperature is at a maximum. Such a construction is generally not cost effective because the resistance to oxidation of the lower cost stainless steel sheet metal alloys at elevated temperatures of 1500 degrees F. to 2200 degrees F. is not sufficient to allow their use in applications where the alloy is exposed to the combustion products normally formed by gasoline fueled internal combustion engines. Because the presently available low cost alloys do not resist oxidation in elevated temperature combustion environments, it is necessary to use a more expensive alloy with high-nickel and/or chromium content in automotive emission control devices, such as thermal reactors. Therefore, the limitation to using currently available, adequate alloy content stainless steels is the high cost and excessive strategic element content.

Degradation of stainless steels at elevated temperatures is largely dependent on the protective capacity of surface oxide films formed from the alloy during exposure to heat in oxygen containing atmospheres. This invention deals with a cost effective method of improving the protective capacity of oxide scales formed on a broad range of wrought austenitic and some ferritic stainless steels.

By way of summary, the methods of the present invention relate to the discovery that certain elements can be added to iron-base alloy materials to dramatically improve their resistance to oxidation. More particularly, the invention relates to the discovery that the addition of these elements (referred to herein as "dopants") yields lower cost materials suitable for use in heretofore impractical environments. The methods of the present invention comprise preparing an iron-base alloy composition exhibiting improved resistance to oxidation comprising the steps of:

(a) admixing in a molten state
  (i) an iron-containing charge;
  (ii) at least one alloy element selected from the group consisting of nickel, chromium, molybdenum, manganese, silicon, carbon, vanadium, cobalt, copper, nitrogen, aluminum, titanium, zirconium, and mixtures thereof; and
  (iii) an effective amount of a dopant selected from the group consisting of lithium, sodium, potassium, yttrium, lanthanum, cerium, calcium, magnesium, barium, aluminum, beryllium, strontium, and mixtures thereof; and
(b) allowing the admixture to cool.

In another embodiment, the methods of the present invention comprise the steps of:

(a) providing an iron-containing alloy comprising
  (i) iron; and
  (ii) at least one element selected from the group consisting of nickel, chromium, molybdenum, manganese, silicon, carbon, vanadium, cobalt, copper, nitrogen, titanium, zirconium, aluminum, and mixtures thereof; and
(b) adding to said iron-containing alloy an effective amount of a dopant selected from the group consisting of lithium, sodium, potassium, yttrium, lanthanum, cerium, calcium, magnesium, barium, aluminum, beryllium, strontium, and mixtures thereof.

In such an embodiment, the dopant is added to the surface of the iron-containing alloy by ion-beam surface modification, laser-induced surface modification, or by the diffusion of a surface coating.

The oxidation problems of the currently available alloy materials, such as a low-nickel austenitic (LNA) stainless steel alloys containing chromium and ferritic stainless steel alloys containing medium to high chromium can be overcome with the addition of an effective amount, preferably at least about 0.02, and more preferably about 0.1 to 2 percent by weight, of the dopants or doping elements or alloys disclosed herein.

Alloy compositions of the present invention would be made in a conventional manner, i.e., typical of the alloy without the dopant of the present invention, but with provisions for the additions of dopant elements, in the melt process or later, in the alloy processing, or by surface treatments.

In the preferred alloys, according to this invention, barium, calcium, lithium, lanthanum/cerium, magnesium, potassium and sodium or mixtures thereof are added to the alloy as dopants.

The methods disclosed herein involves the addition of small quantities of dopants (appearing for the most part in Groups IA, IIA and IIIB of the Periodic Table of Elements) to the base alloy composition. These elements, as ions, enter into the protective oxide scale and modify predominantly anion (and to a leser extent, cation) transport through the oxide scale, greatly reducing the amount of oxidation observed due to elevated temperature exposure.

Research leading to this invention was based on low nickel austenitic (LNA) alloy composition and was guided by extensive use of experimental design. Initially, a 28 run balanced orthogonal array fractional factorial scheme according to Plackett and Burman was employed as a screening method to identify main-effect influences on oxidation resistance of 26 constituents from the Periodic Table of Elements. For this work, reference was made to an article entitled "The Design Of Optimum Multifactorial Experiments" by R. L. Plackett and J. P. Burman (*Biometrika,* 1946, pages 305–327) which is hereby expressly incorporated by reference; an article entitled "Some Generalizations In The Multifactorial Design" by R. L. Plackett (*Biometrika,* 1946, pages 328–332) which is hereby expressly incorporated by reference; and to an article entitled "Table Of Percentage Points Of The T-Distribution" by Elizabeth M. Baldwin (*Biometrika,* 1946, page 362) which is also hereby expressly incorporated by reference. Selection criteria for elements to be considered included commercial availability in quantities sufficient to support volume alloy production, cost and subject reasoning as to the elements' ability to be a stable part of the alloy composition. Fitting these 26 constituents into the 28 run experimental design left 2 columns for random variation or error determination. The Table I lists these constituents by Periodic Table groupings. Note that La-Ce is considered as one constituent because these two elements co-exist as a commercial rare-earth product. Table II lists elements considered as part of the base composition and therefor not included in the oxidation improvement design scheme.

TABLE I

| Periodic Table Group | Constituent |
|---|---|
| IA | Li, Na, K |
| IIA | Be, Mg, Ca, Sr, Ba |
| IIIA | B, Al |
| IVA | Si, Sn |
| VA | Pb, Sb, Bi |
| IB | Cu |
| IIB | Zn |
| IIIB | Y, La-Ce |
| IVB | Ti, Zr |
| VB | V, Nb, Ta |
| VIB | Mo, W |

TABLE II

| Periodic Table Group | Constituent |
|---|---|
| IVA | C |
| VA | N |
| VIB | Cr |
| VIIB | Mn |
| VIII | Fe, Co, Ni |

Elements associated with improvements in oxidation resistance, as determined by the Plackett-Burman experimental design, were then incorporated in full factorial experimental designs of the form $2^3$ to $2^6$ for identification of interactions and $3^2$ to $3^3$ for quantifying certain effects. The notation $Y^X$ refer to X factors evaluated at Y levels each for a total of $Y^X$ test runs. Similar notations and documentation of full factorial experimental designs and analysis can be found in the literature. For this work, reference was made to "Industrial Statistics" by W. Volk (*Chemical Engineering,* March 1956) which is hereby expressly incorporated by reference. Interactions in this context are those situations wherein the main effect between certain variables change as a function of changes in other variables.

In the course of this research, it was found that elements within the alloy functioned in three identifiable ways: Austenite Stabilizers, Oxide Formers and Oxide Dopants. Understanding of these functions is helpful in describing the alloys of this invention.

Austenite Stabilizers

Austenitic alloys of this invention may require small compositional adjustments to maintain a stable austenitic matrix at use temperatures up to 2,220 degrees F.. Elements identified as promoting this austenite stability are Mn, Co, Ni, Cu, C, Sn, Sb, Bi and N. Throughout the course of developing this invention, it was necessary to periodically adjust the choice and quantity of austenite stabilizer elements to balance the counteracting effects of La-Ce, Ti, Zr, V, Cr, Al and Si as these elements were introduced or changed in concentration as part of the effort to determine their effect on oxidation resistance.

Oxide Formers

An object of this invention is to improve the protective nature of surface oxides formed during exposure to elevated temperatures and, therefore, a stable surface oxide is required. Elements identified as significant contributors to stable surface oxide formation on these iron base alloys are: Cr, Co, Ni, Al, and Si. The elements Cr, Co and Ni were part of the base composition, individually or in combination, Table II, and therefore not subject to elevation during the fractional factorial phase of this investigation. Al and Si were incorporated into the initial experimental design (Table I) and were determined to contribute to improved oxidation resistance through interaction with dopant elements. This interaction is interpreted to be due to the contribution of Al and Si in formation of stable surface oxides.

Dopants

Dopants are elements found to have a major effect on the protective nature of the host oxide. Typically, they are found in groups IA, IIA and IIIB of the Periodic Table of Elements and include, without limitation, those described herein, as well as mixtures of these materials. Their function in improving oxidation resistance is judged to be due to their effect on predominantly anion and to a lesser extent cation transport through the surface oxide film.

DESCRIPTION OF THE DRAWINGS

Other objects, features and advantages of the present invention will become more fully apparent from the following detailed description of the preferred embodiment, the appended claims and in the accompanying drawings in which:

FIG. 2 shows a photomicrograph of the standard composition 310 SS after 2,887 hours cyclic oxidation at 1900 degrees F. taken from the test panel of FIG. 1; and FIG. 3 shows a photomicrograph of the doped composition 310 SS after 2,887 hours cyclic oxidation at 1900 degrees F. taken from the test panel of FIG. 1.

DETAILED DESCRIPTION OF THE PREFERRED EMBODIMENT

Figure 1:
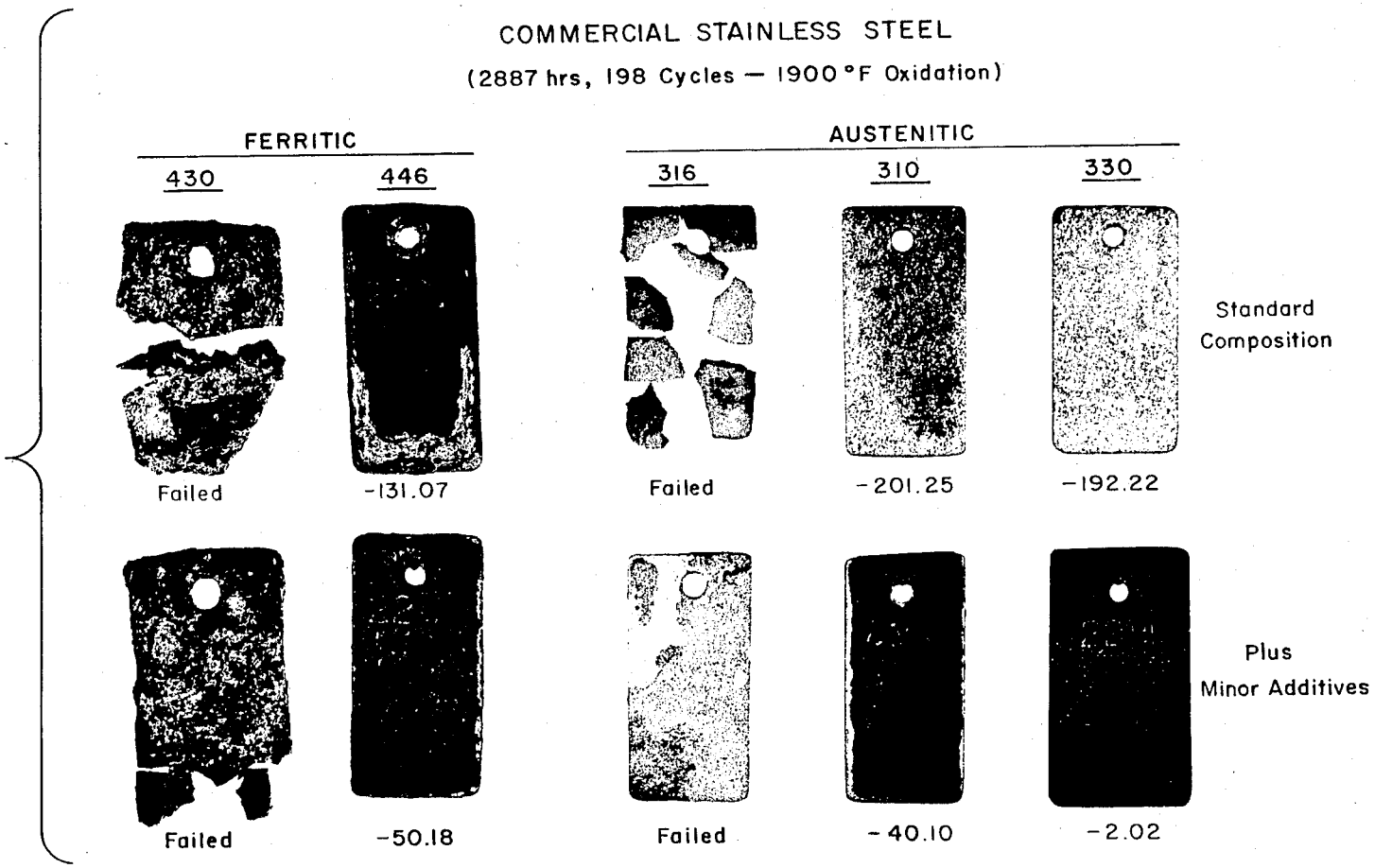
FIG. 1 shows a representative sample of commercial ferritic and austenitic stainless steel cyclic oxidation test panels with standard composition and doped compositions after 2,887 hours of cyclic oxidation testing at 1900 degrees F.

All percentages herein are by weight of the final composition, unless otherwise indicated.

This is one of four applications all filed on the same day. All of the applications deal with related inventions. They are commonly owned and have the same inventor. The claims, drawings and description in each application are unique, but incorporate the others by reference. Accordingly, the following three applications are hereby expressly incorporated by reference: "Oxidation Resistant Iron Base Alloy Compositions"; "Non-Iron Base Alloy Compositions"; and "Method of Preparing Non-Iron Base Alloy Compositions." These are now, respectively, U.S. Ser. No. 938,179; U.S. Ser. No. 938,182; and U.S. Ser. No. 938,181.

The methods of the present invention relate to the discovery that certain elements can be added to iron-base alloy materials to dramatically improve their resistance to oxidation. More particularly, the invention relates to the discovery that the addition of these elements (referred to herein as "dopants") yields materials suitable for use in heretofore impractical environments thereby avoiding the use of expensive higher alloy-content materials.

The methods of the present invention comprise preparing an iron-base alloy composition exhibiting improved resistance to oxidation comprising the steps of:

(a) admixing in a molten state
  (i) an iron-containing charge;
  (ii) at least one alloy element selected from the group consisting of nickel, chromium, molybdenum, manganese, silicon, carbon, vanadium, cobalt, copper, nitrogen, aluminum, titanium, zirconium, and mixtures thereof; and
  (iii) an effective amount of a dopant selected from the group consisting of lithium, sodium, potassium, yttrium, lanthanum, cerium, calcium, magnesium, barium, aluminum, and mixtures thereof; and
(b) allow the admixture to cool.

Accordingly, in a preferred embodiment, the methods of the present invention relate to preparing an iron-base alloy composition exhibiting improved resistance to oxidation comprising the steps of:

(a) admixing in a molten state
  (i) iron;
  (ii) at least one alloy element selected from the group consisting of silicon, nickel, chromium, manganese, cobalt, nitrogen, and mixtures thereof; and
  (iii) an effective amount of a dopant selected from the group consisting of lithium, sodium, potassium, yttrium, lanthanum, cerium, calcium, magnesium, barium, aluminum, and mixtures thereof; and
(b) allowing the admixture to cool.

In another preferred aspect, the methods of the present invention relate to a method of preparing and iron-base alloy composition exhibiting improved resistance to oxidation comprising the steps of:

(a) providing an iron-containing alloy comprising
  (i) iron; and
  (ii) at least one alloy element selected from the group consisting of nickel, chromium, molybdenum, manganese, silicon, carbon, vanadium, cobalt, copper, nitrogen, titanium, zirconium, aluminum, and mixtures thereof; and
(b) adding to said iron-containing alloy an effective amount of a dopant selected from the group consisting of lithium, sodium, potassium, yttrium, lanthanum, cerium, calcium, magnesium, barium, aluminum, beryllium, strontium, and mixtures thereof.

The dopant may be added to the surface of the iron-containing alloy by any effective means, or in any conventional manner. For example, the dopant may be added to the surface of the alloy by iron-beam surface modification, by laser-induced surface modification, or by the diffusion of a surface coating.

Such methods of addition are known in the art. For example, effective methods of surface modification and/or surface coating are disclosed in *Metals Handbook*, Eighth Edition, Volume 2, Lyman, pages 507–516; and *Materials Science & Engineering*, Volume 70, Appleton et al., pages 23–51; both of which are expressly incorporated herein by reference.

The compositions which result from the methods of the present invention comprise iron-base alloy compositions exhibiting improved resistance to oxidation comprising:

(i) iron;
(ii) at least one alloy element selected from the group consisting of nickel, chromium, molybdenum, manganese, silicon, carbon, vanadium, cobalt, copper, nitrogen, aluminum, titanium, zirconium, and mixtures thereof; and
(iii) an effective amount of a dopant selected from the group consisting of lithium, sodium, potassium, yttrium, lanthanum, cerium, calcium, magnesium, barium, aluminum, beryllium, strontium, and mixtures thereof.

By the term "iron-base", as used herein, is meant that iron is the predominate alloy element present, by weight of the final composition. Thus, while one or more other alloy elements may be employed, iron may be present at a level greater than any other single element by weight. Iron need not comprise 50 percent of the composition; by way of illustration (without limitation), a composition comprising 30 percent iron, by weight, and 29 percent nickel by weight, and other elements, each being less than 30 percent by weight, but in aggregate totaling more than 50 percent by weight (including the nickel) would be iron-base as defined herein.

By the term "effective amount", as used herein, it is meant an amount of the dopant sufficient to show a significant and reproducible improvement in one or more oxidation-resistant properties of the final compositions. Such properties would include weight change, surface appearance as measured by gross observation and micro observation by metallography as described herein. For example, when two alloy compositions, differing in only that one contains an effective amount of a dopant, and the other containing less than an effective amount or no dopant are compared, the alloy containing an effective amount will demonstrate a significant and reproducible improvement in one or more oxidation-resistant properties.

Preferred alloy elements include those selected from the group consisting of silicon, nickel, chromium, cobalt, manganese, nitrogen, and mixtures thereof. Silicon, nickel, and chromium are particularly preferred.

Iron, as well as the alloy elements described above, can be employed at levels generally known in the art. For example, the dopants of the present invention may be employed in AISI types 201, 202, 301, 302, 302B, 303, 303Se, 304, 304L, 305, 308, 309, 309S, 310, 315, 316, 316L, 317, 321, 347, 348, 384 and 385 austenitic stainless steels; and AISI types 405, 429, 430, 430F–430Se, 434, 436 and 446, ferritic stainless steels. Employing the dopants of the present invention, in addition to the elements at levels conventionally employed (except for small modifications to maintain matrix stability, if needed) in such AISI materials produces materials which can then be employed in heretofore impossible or impractical environments or applications. Also, the compositions prepared by the methods of the present invention can also employ lower levels of strategic or expensive elements than generally disclosed in the art, but at the same time demonstrating equivalent or improved oxidation-resistant properties. Stainless steel (RA 333) and non-stainless steel(INCO 330) may also employ the dopants of the present invention.

A specific application using the methods of the present invention produce compositions including those where nickel is present at a level of about 5 to about 15 percent, and where chromium is present at a level of about 10 to about 30 percent, by weight of the final composition.

The compositions and methods of the present invention employ an effective amount of a dopant. Preferred dopants are primarily selected from the group consisting of elements from Groups IA, IIA and IIIB of the Periodic Table of Elements. These include lithium, sodium, potassium, yttrium, lanthanum, cerium, calcium, magnesium, barium, aluminum, beryllium, and strontium. Mixtures of such materials may also be employed. Highly preferred materials include lithium, sodium, potassium, yttrium, lanthanum, cerium, calcium, magnesium, barium, aluminum and mixtures thereof.

Preferred mixtures include magnesium and calcium with lithium, sodium, potassium, lithium and sodium, and lithium and potassium.

It should be noted that, while aluminum can play many important roles in the methods of the present invention, it can be used as an effective dopant when employed at levels below that at which it acts as a bulk oxide former.

As stated, the dopant is employed in the compositions and methods of the present invention in an effective amount. Such a level will vary with many factors, including, without limitation, the level of the various other elements, materials or impurities present, such as iron, nickel, chromium and the like, as well as the desired improvement in oxidation resistance. The selection of such a level is well within the skill of the artisan in light of the present disclosure and teachings.

In general, the dopant is present at a level of about at least about 0.02 percent, by weight of the final composition.

In a preferred embodiment, the dopant is present at a level of about 0.05 to about 5 percent; still more preferably at a level of about 0.1 to about 3.5 percent; and still more preferably at a level of about 0.1 to about 2.0 percent.

In a highly preferred embodiment, the dopant comprises magnesium, calcium, lithium, sodium, and potassium; the magnesium is present at a level of about 0.1 to about 1.5 percent; the calcium is present at a level of about 0.1 to about 1.5 percent; the lithium is present at a level of about 0.1 to about 0.5 percent; the sodium is present at a level of about 0.1 to about 0.5 percent; the potassium is present at a level of about 0.5 to about 1.0 percent.

In a specific application using these method, an alloy of the present invention would be made with about 20 to 30 percent by weight chromium, about 0.1 to 1.5 percent by weight carbon, about 3 to 4 percent by weight manganese, about 0 to 12 percent by weight cobalt, about 5 to 15 percent by weight nickel, and about 0.5 to 2 percent by weight dopant, with the balance being iron and normal residual impurities.

In general, the alloys and compositions resulting from the methods of this invention can be described as oxidation resistance steels having iron as the base material with the addition of chromium and other alloying elements to increase oxidation resistance. The preferred methods of the present invention produce alloys that contain minor quantities of dopant elements. Nickel, cobalt, nitrogen, carbon and manganese are strong austenite stabilizers in ferrous alloys. Accordingly, in a preferred austenitic alloy embodiment, the level of these elements employed in the methods of the present invention result in a level in the alloy that is high enough to ensure that the alloy's structure remains austenitic over the temperature range normally encountered by parts formed from the alloy.

Some of these austenitic alloys are alluded to in an SAE Paper No. 740093 by A. Roy, F. A. Hagen and J. M. Corwin entitled "Performance Of Heat Resistant Alloys In Emission-Control Systems", which is hereby expressly incorporated by reference.

In the description of doping agents hereinafter, all percentages are by weight unless specifically noted.

Dopants are used in this invention to improve the oxidation resistance of commercial ferritic and austenitic alloys. For example, at 1,900 degrees F., 446 stainless steel shows a 61.7 percent improvement, 310 stainless steel shows an 80 percent improvement and 330 stainless steel shows a 98.9 percent improvement based on weight loss after 2,887 hours of cyclic furnace oxidation at 1,900 degrees F. in air.

The still-air cyclic oxidation tests were conducted in laboratory muffle type furnaces at temperatures ranging from 1,350 to 2,200 degree F. Small test panels, 1"×2"×0.030" thick, were hung on racks that were cycled twice a day between room temperature and the furnace test temperature. Weight changes were recorded periodically after a light brushing to remove loose oxide. The results are reported as a unit weight change - either plus or minus. Loose scale is not collected, nor are the samples chemically descaled prior to the weighing.

Weight change data by itself can be quite misleading when comparing several different alloys if the mode of corrosive attack is not similar in each case. Metallography was used in most cases to supplement weight change data. Photomicrographs, therefore, are required to illustrate the point.

Referring to FIG. 1, in all cases the doped versions of the commercial base alloys outperformed the base compositions in exhibiting the least weight change, in $mg/cm^2$, over the cycles of testing. Even in the cases of the relatively low alloy 430 and 316 stainless steels, it is apparent from the physical appearance of the sample remains that the doped version has greater resistance to deterioration although missing pieces made weight measurements meaningless. The laboratory procedure used in producing these samples consists of melting the standard compositions, casting an ingot for subsequent processing, and then adding the dopant to the balance of the heat prior to casting a second ingot of the doped composition. Reduction to wrought form for test panel fabrication followed standard hot forge, hot roll and cold roll laboratory procedures for converting cast ingots to wrought strip of approximately 0.030" thickness.

The damaging effect of cyclic, still air oxidation on an undoped alloy can be seen in the photomicrograph of the unetched microstructure of standard composition 310 stainless steel shown in FIG. 2. Intergranular oxidation is extensive. Final thickness has decreased from the nominal 0.030" to approximately 0.019" with most of the mechanical integrity lost due to internal oxidation. Constrast this with the unetched microstructure of the same base composition containing additions of 0.5% Ca, 0.5% Mg and 0.5% La-Ce shown in FIG. 3. In this case, internal oxidation has been subdued with no evidence of deep intergranular attack. The orginal 0.030" thickness, 88 percent of which is still mechanically sound has been preserved.

Those skilled in the art realize that commercial alloys of the type considered here (e.g.; 430, 446, 316, 310 and 330 stainless steels) can undergo at least two types of oxidation reactions when exposed to elevated temperatures in the presence of oxygen containing atmospheres. FIG. 4 diagrams each of these reactions. Reaction 1 involves outward metal ion (cation) migration from the host alloy substrate through the protective oxide scale where reaction takes place with oxygen at or near the outer surfaces of the scale to form new metal oxide or scale. This is referred to as external oxidation.

Diffusion rates of typical scale forming metal ions is relatively slow contrasted with oxygen diffusion and the consequences are generally not as damaging to the alloy's mechanical properties as is internal oxidation.

Reaction 2 of FIG. 4 termed internal oxidation involves oxygen diffusion through the oxide scale leading to combination with host alloy elements to form internal oxides. Because diffusion rates are typically fast along host alloy grain boundaries, internal oxidation is often manifested as grain boundary oxidation which can cause substantial degradation to the alloy's mechanical properties.

Doping of alloys according to this invention substantially prevents reaction 2 from occurring and appears in a few cases to have a slowing effect on reaction 1.

Elements from Groups IA, IIA and IIIB of the Periodic Table of Elements are the active ingredients in this dopant concept.

While the present invention has been disclosed in connection with the preferred embodiment thereof, it should be understood that there may be other embodiments which fall within the spirit and scope of the invention and that the invention is susceptible to modification, variation and change without departing from the proper scope or fair meaning of the following claims.

I claim:

1. A method of preparing an iron-base alloy composition exhibiting improved resistance to oxidation comprising the steps of:

(a) admixing in a molten state;

(i) an iron-containing charge;

(ii) at least one alloy element selected from the group consisting of nickel, chromium, molybdenum, manganese, silicon, carbon, vanadium, cobalt, copper, nitrogen, aluminum, titanium, zirconium and mixtures thereof; and (iii) an amount of a dopant element sufficient to show a significant and reproducible improvement in one or more oxidation resistant properties of the final composition selected from the group consisting of lithium, sodium, potassium, yttrium, lanthanum, cerium, calcium, magnesium, barium, aluminum, beryllium, strontium, and mixtures thereof; and (b) allowing the admixture to cool.

2. A method according to claim 1 wherein the alloy element is selected from the group consisting of silicon, nickel, chromium, cobalt, manganese, nitrogen, and mixtures thereof.

3. A method according to claim 1 wherein the dopant is selected from the group consisting of magnesium, calcium, lithium, sodium, potassium, and mixtures thereof.

4. A method according to claim 1 wherein the dopant is present at a level of at least about 0.02 percent, by weight of the final composition.

5. A method according to claim 4 wherein the dopant is present at a level of about 0.05 to about 5 percent, by weight of the final composition.

6. A method according to claim 5 wherein the dopant is present at a level of about 0.1 to about 3.5 percent, by weight of the final composition.

7. A method according to claim 6 wherein the dopant is present at a level of about 0.1 to about 2.0 percent, by weight of the final composition.

8. A method according to claim 1 wherein the dopant comprises magnesium; and further wherein the magnesium is present at a level of about 0.1 to 0.5 percent, by weight of the final composition.

9. A method according to claim 8 wherein the dopant additionally comprises calcium; said calcium being present at a level of about 0.1 to about 0.5 percent, by weight of the final composition.

10. A method according to claim 9 wherein the dopant additionally comprises lithium; and further wherein the lithium is present at a level of about 0.1 to about 0.5 percent, by weight of the final composition.

11. A method according to claim 10 wherein the dopant additionally comprises sodium, said sodium being present at a level of about 0.1 to about 0.5 percent, by weight of the final composition.

12. A method according to claim 11 wherein the dopant additionally comprises potassium, said potassium being present at a level of about 0.1 to about 1.0 percent, by weight of the final composition.

13. A method according to claim 1 wherein the dopant comprises magnesium, calcium, lithium, sodium, and potassium, and wherein said magnesium is present at a level of about 0.1 to about 0.5 percent, said calcium is present at a level of about 0.1 to about 0.5 percent, said lithium is present at a level of about 0.1 to about 0.5 percent, said sodium is present at a level of about 0.1 to about 0.5 percent, and said potassium is present at a level of about 0.1 to about 1.0 percent, by weight of the final composition.

14. A method according to claim 2 wherein said nickel is present at a level of about 5 to about 15 percent, by weight of the final composition.

15. A method according to claim 2 wherein said chromium is present at a level of about 10 to about 30 percent, by weight of the final composition.

16. A method according to claim 4 wherein the dopant comprises lithium.

17. A method according to claim 4 wherein the dopant comprises sodium.

18. A method according to claim 4 wherein the dopant comprises potassium.

19. A method according to claim 4 wherein the dopant comprises yttrium.

20. A method according to claim 4 wherein the dopant comprises lanthanum.

21. A method according to claim 4 wherein the dopant comprises cerium.

22. A method according to claim 4 wherein the dopant comprises calcium.

23. A method according to claim 4 wherein the dopant comprises magnesium.

24. A method according to claim 4 wherein the dopant comprises barium.

25. A method according to claim 4 wherein the dopant comprises aluminum.

26. A method according to claim 4 wherein the dopant comprises strontium.

27. A method according to claim 4 wherein the dopant comprises beryllium.

28. A method of preparing an iron-base alloy composition exhibiting improved resistance to oxidation comprising the steps of:

(a) admixing in a molten state (i) iron;

(ii) at least one alloy element selected from the group consisting of silicon, nickel, chromium, manganese, cobalt, nitrogen, and mixtures thereof; and (iii) an amount of a dopant element sufficient to show a significant and reproducible improvement in one or more oxidation resistant properties of the final compositions selected from the group consisting of lithium, sodium, potassium, yttrium, lanthanum, cerium, calcium, magnesium, barium, aluminum and mixtures thereof; and (b) allowing the admixture to cool.

29. A method according to claim 28 wherein the dopant is selected from the group consisting of magnesium, calcium, lithium, sodium, potassium, and mixtures thereof.

30. A method according to claim 28 wherein the dopant is present at a level of about 0.02 to about 5 percent, by weight of the final composition.

31. A method according to claim 30 wherein the dopant is present at a level of about 0.05 to about 5 percent, by weight of the final composition.

32. A method according to claim 31 wherein the dopant is present at a level of about 0.1 to about 3.5 percent, by weight of the final composition.

33. A method according to claim 32 wherein the dopant is present at a level of about 0.1 to about 2.0 percent, by weight of the final composition.

34. A method according to claim 28 wherein the dopant comprises magnesium, calcium, lithium, sodium, and potassium, and wherein said magnesium is present at a level of about 0.1 to about 0.5 percent, said calcium is present at a level of about 0.1 to about 0.5 percent, said lithium is present at a level of about 0.1 to about 0.5 percent, said sodium is present at a level of about 0.1 to about 0.5 percent, and said potassium is present at a level of about 0.1 to about 1.0 percent, by weight of the final composition.

35. A method of preparing an iron-base alloy composition exhibiting improved resistance to oxidation comprising the steps of:

(a) providing an iron-containing alloy comprising (i) iron; and (ii) at least one alloy element selected from the group consisting of nickel, chromium, molybdenum, manganese, silicon, carbon, vanadium, cobalt, copper, nitrogen, titanium, zirconium, aluminum and mixtures thereof; and (b) adding to said iron-containing alloy an amount of a dopant element sufficient to show a significant and reproducible improvement in one or more oxidation resistant properties of the final compositions selected from the group consisting of lithium, sodium, potassium, yttrium, lanthanum, cerium, calcium, magnesium, barium, aluminum, beryllium, strontium and mixtures thereof.

36. A method according to claim 35 wherein the dopant is added to the surface of the iron-containing alloy.

37. A method according to claim 36 wherein the dopant is added by ion-beam surface modification.

38. A method according to claim 36 wherein the dopant is added by laser-induced surface modification.

39. A method according to claim 36 wherein the dopant is added by the diffusion of the surface coating.

* * * * *